US009387381B1

(12) United States Patent
Garces

(10) Patent No.: US 9,387,381 B1
(45) Date of Patent: Jul. 12, 2016

(54) SPORTS DEVICE AND METHOD FOR ATHLETIC COMPETITION AND TRAINING

(71) Applicant: Hector Garces, Ada, MI (US)

(72) Inventor: Hector Garces, Ada, MI (US)

( * ) Notice: Subject to any disclaimer, the term of this patent is extended or adjusted under 35 U.S.C. 154(b) by 0 days.

(21) Appl. No.: 14/586,230

(22) Filed: Dec. 30, 2014

(51) Int. Cl.
*A63B 69/00* (2006.01)

(52) U.S. Cl.
CPC ..... *A63B 69/00* (2013.01); *A63B 69/004* (2013.01); *A63B 2225/09* (2013.01)

(58) Field of Classification Search
USPC ..... 434/247, 251; 473/458, 502; 441/75
See application file for complete search history.

(56) References Cited

U.S. PATENT DOCUMENTS 2,846,224 A * 8/1958 Roselle ..... A63B 67/00 2/300
2,986,396 A * 5/1961 Abbott ..... A63B 67/00 2/300
3,063,718 A * 11/1962 Steinkamp ..... A63B 67/00 128/DIG. 15
3,345,070 A * 10/1967 Wilson ..... A41F 9/002 473/502
3,498,610 A * 3/1970 Foley ..... A63H 33/02 273/447
4,041,562 A * 8/1977 Nealy ..... B63B 35/7933 24/3.2
4,149,540 A * 4/1979 Hasslinger ..... A61B 17/1322 128/DIG. 15
4,651,989 A * 3/1987 Wilson ..... A41F 9/002 2/321
4,688,564 A * 8/1987 Kelly ..... A47D 13/086 128/878
4,757,995 A * 7/1988 Gallagher ..... A63B 69/0002 434/255
4,763,821 A * 8/1988 Powell ..... A45C 1/04 224/222
5,002,273 A * 3/1991 Sela ..... A63B 21/28 434/248
5,456,462 A * 10/1995 Wilson ..... A41F 9/002 473/502
5,938,549 A * 8/1999 Schenkenfelder ..... A63B 67/00 473/502
5,957,741 A * 9/1999 Evans ..... B63B 35/7933 441/75
6,004,232 A * 12/1999 Sennott ..... A63B 67/00 473/415
6,241,631 B1 * 6/2001 Wilson ..... A44B 11/04 473/502
6,500,039 B1 * 12/2002 Underwood ..... B63B 35/7933 119/770
D511,713 S * 11/2005 Carbonero ..... D11/212
D706,532 S * 6/2014 Wilbur ..... D3/215
8,833,310 B2 * 9/2014 Konigsberg ..... A01K 27/00 119/770
8,894,457 B1 * 11/2014 Crozier ..... B63B 35/7933 441/75
2009/0042675 A1 * 2/2009 Baun, II ..... A63B 67/00 473/502
2009/0098957 A1 * 4/2009 Hitchcock ..... A63B 67/00 473/502
2012/0216333 A1 * 8/2012 Dewese ..... A41D 23/00 2/207

* cited by examiner

*Primary Examiner* — Kurt Fernstrom
(74) *Attorney, Agent, or Firm* — Mitchell Intellectual Property Law, PLLC

(57) ABSTRACT

In the present invention, players train for and compete in a wrestling type competition by wrapping a releasable sports strap around at least one of their ankles. The sports strap comprises an ankle wrap portion which is worn around the ankle and a releasable fastener. The sports strap includes a pull strap extending from the exposed end of the wrap portion. The pull strap is long enough and wide enough that it can be grasped and pulled by the hand of a competitor during the competition. From a starting position, the competitors attempt to be the first to grasp the other's pull strap, and pull on it to unfasten and remove the other's sports strap from his or her ankle. The sports strap can be used as part of a training method for wrestlers.

21 Claims, 4 Drawing Sheets

SPORTS DEVICE AND METHOD FOR ATHLETIC COMPETITION AND TRAINING

FIELD AND BACKGROUND OF THE INVENTION

The present invention relates to wrestling type athletic competition, training method and sports device for such competition and training.

SUMMARY OF THE INVENTION

In the present invention, players train for and compete in a wrestling type competition by wrapping a sports strap around at least one of their ankles. The soft, non-abrasive and flexible ankle wrap portion of the sports strap is secured around the ankle by a releasable fastener such as a hook and loop type fastener, and includes a pull strap extending from the exposed end of the ankle wrap portion when in a wrapped position. The pull strap is long enough and wide enough that it can be grasped and pulled by the hand of a competitor during the competition without easily slipping through the competitor's grasp. When pulled the fastener releases and the strap is removed from the ankle. From a starting position, the competitors attempt to be the first to grasp the other's pull strap, and pull on it to unfasten and remove the other's sports strap from his or her ankle. The sports strap can be used as part of a training method for wrestlers.

DETAILED DESCRIPTION OF THE INVENTION

Figure 1:
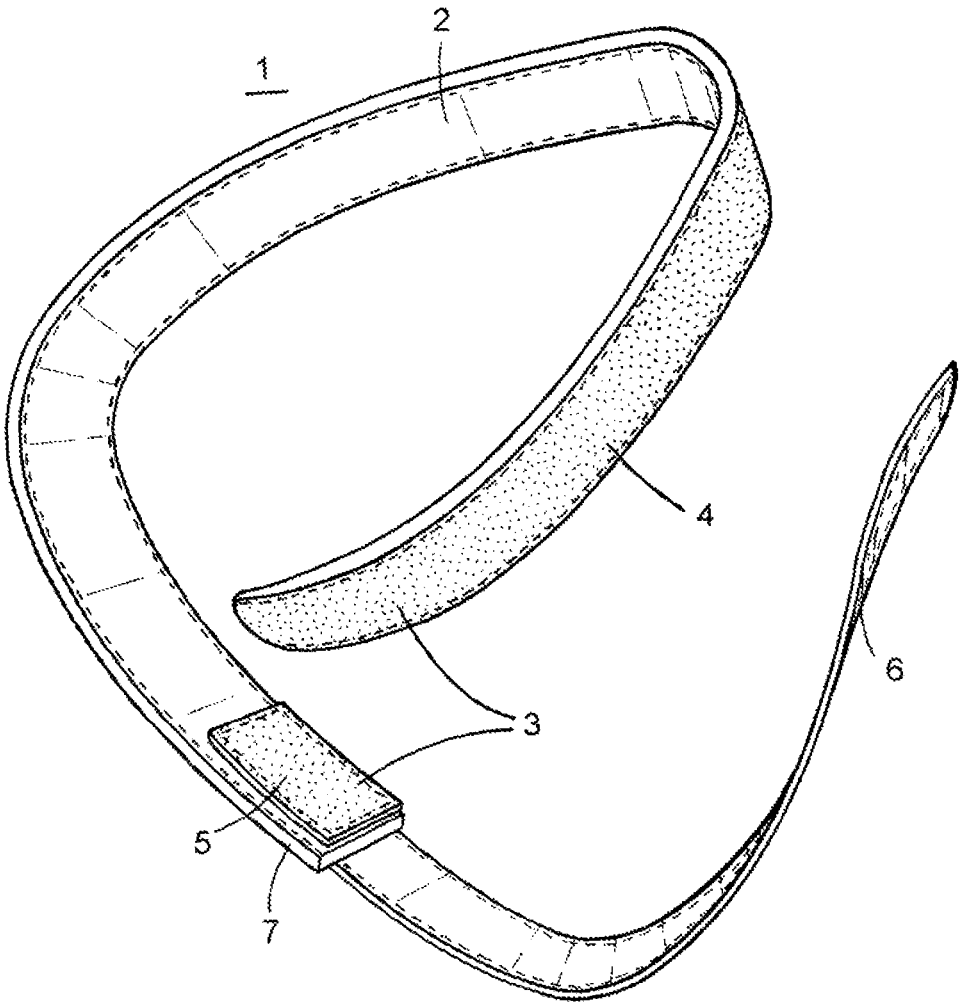
FIG. 1 is a perspective view of a sports strap of the preferred embodiment, coiled but not fastened.
Figure 2:
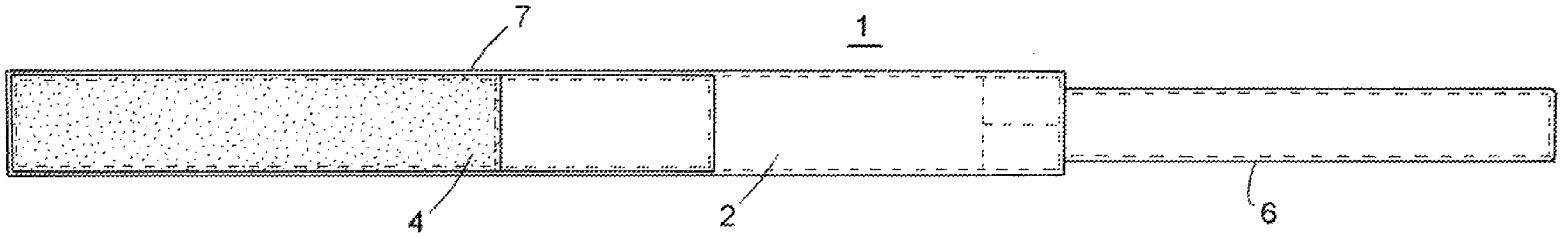
FIG. 2 is a plan view of what will be the outside of the sports strap as worn.
Figure 3:
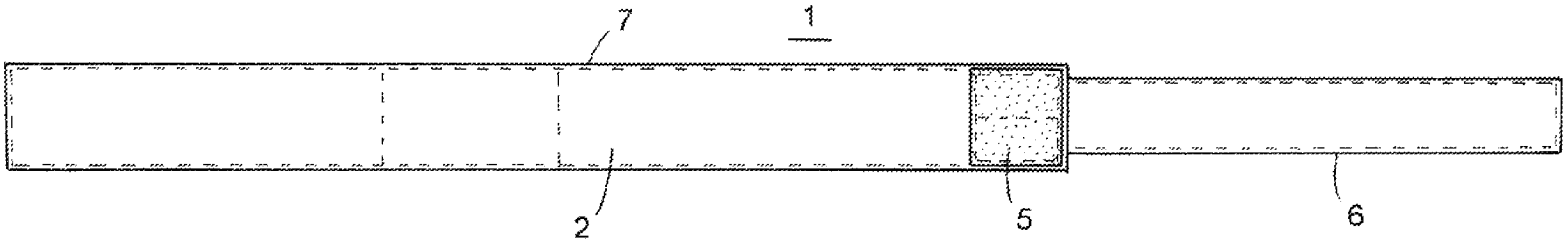
FIG. 3 is a plan view of what will be the inside of the sports strap as worn.

In the drawings and following description, the numbers indicate the parts of sports device:

1. Sports strap.
2. Ankle wrap portion.
3. Fastener.
4. Loop pad of a hook and loop fastener.
5. Hook pad of a hook and loop fastener.
6. Pull strap.
7. Longitudinal edges of the ankle wrap.
8. One folded over longitudinal edge of ankle wrap 2.

The sports device illustrated in the embodiment shown in the Figures comprises an elongated sports strap 1, an ankle wrap portion 2, a releasable fastener 3 comprising a loop pad 4 on the side that will be the outside of the strap when fastened around a person's ankle and a hook pad 5, which is placed on the opposite side of the ankle wrap portion 2 and when the strap 1 is curled around a person's ankle will mate with the loop pad. A pull strap 6 extends from one end of the ankle wrap portion 2 where the hook fastener is located. This is the exposed end of the ankle wrap portion when wrapped around an ankle. Velcro brand hook and loop fasteners are an example of suitable fasteners. Other fasteners such as snaps and the like can also be employed.

The ankle wrap portion 2 is preferably made from a soft, non-abrasive and flexible material. It should be wide enough that it is not easy to fasten around a person's ankle if in a twisted position. It should be long enough that it wraps around the user's ankle and allows overlap of the hook pad 5 located on the inside of and adjacent one end of the ankle wrap portion 2, with the longer loop pad 4 located on the outside of and extending on the other end of the ankle wrap portion. The hook pad 5 of the fastener should preferably overlap far enough that it is seated entirely on the loop pad 4. No portion of the stiff abrasive hook pad should be exposed to the user's skin when the sports strap is in place. Because the hook pad is normally both stiff and abrasive, it should be just long enough to effect a good attachment to the longer loop pad. The loop pad should be long enough to permit the ankle wrap portion to wrap around varying ankle sizes and still allow securement of the hook pad to the loop pad.

The material from which the ankle wrap portion is made is a flexible soft material such as leather, cotton or the like.

The pull strap can comprise the same material as the ankle wrap portion but preferably is made from a strong material such as webbing made from synthetic material such as nylon or other synthetic polymers. The pull strap should be long enough and wide enough that it can be grasped and pulled by the hand of a competitor during the competition or training, without easily slipping through the competitor's grasp.

Figure 4:
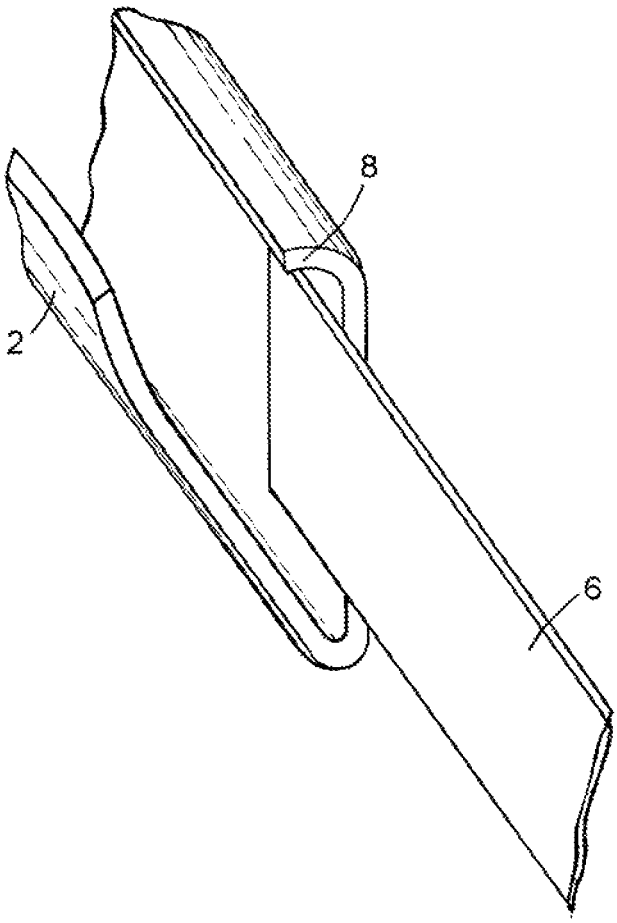
FIG. 4 is a perspective view of the end portion of the sports strap showing an embodiment where the ankle wrap portion is made by folding over an elongated piece of material along its length and around the end portion of the pull strap.
Figure 5:
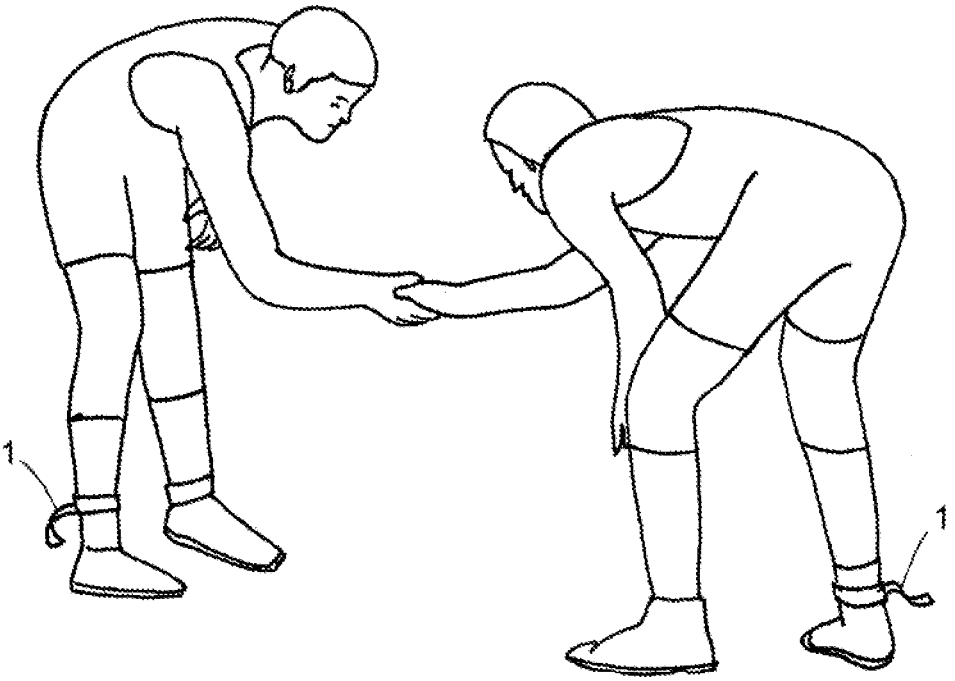
FIG. 5 shows competitors in a standing position wearing the sports straps on one of their ankles.
Figure 6:
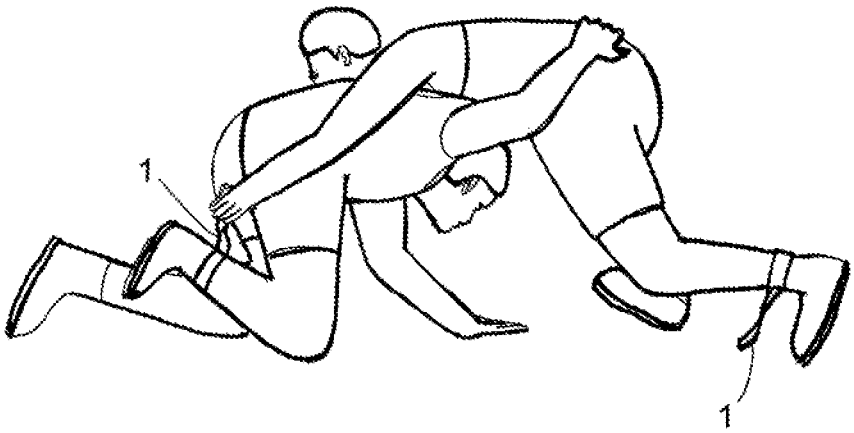
FIG. 6 shows competitors wrestling, with one reaching for his competitor's sports strap.

To make the device an elongated ankle wrap material is folded approximately in half lengthwise, and preferably with one of the longitudinal edges 7 of one side extending slightly above the other, so that it can be folded over the top of the other edge (number 8, FIG. 4.) and then secured by sewing, gluing or otherwise sealing. This provides relatively smooth, soft longitudinal edges on each of the longitudinal sides of the ankle wrap portion. A portion of the pull strap is left inside the envelope defined by ankle wrap portion, and is sewn, glued or sealed therein, such that the pull strap is permanently affixed to the ankle wrap portion, and extends, preferably from the end thereof that will be exposed when the ankle wrap is wrapped around an ankle.

Preferably, the ankle wrap 2 has a length of 10 to 20 inches, most preferably 15 inches. Its preferable width is from about 1¼ to about 2¼ inch, most preferably about 1¾ inches. The loop fastener material 4 is preferably about ¼ to ½ inch narrower than ankle wrap 2, and preferably from about ⅓ to ½ the length of wrap 2. The hook pad 5 is also preferably about ¼ to ½ inch narrower than ankle wrap 2, and has a length of from about 1 to 2 inches, most preferably about 1½ inch. The length of pull strap 6 is preferably 6 to 10 inches, most preferably 6 inches. Its width is about ½ to about 1½ inches, most preferably about 1 inch.

An example of a device of the invention was made having the following dimensions:

Ankle wrap portion: length 19 inches, width 1¾ inch;
Loop fastening pad on outer side of ankle wrap portion: length 8¾ inch, width 1½ inch;
Hook fastening pad on inner side of ankle wrap portion: length 1½ inch×width 1½ inch;
Pull strap portion: extends from the end of ankle wrap portion: 8¾ inch×1 inch. It should be noted that the loop and hook pads are slightly narrower than the ankle wrap portion. This assists in assuring the longitudinal edges of the ankle wrap portions are non-abrasive.

In one variation of the wrestling training method of the invention, two competitors each attach one of the devices of the invention to one ankle. They then face off or take top and bottom positions or other positions and then attempt to grab and pull off the other competitor's sport strap from their ankle while maneuvering to prevent the competitor from grabbing and pulling his strap off. The training period can be timed and the training continued for as long as desired. Variations of such training methods can be done. For example, to focus on offense or defense, only one competitor has on a sports strap either on only one leg or both legs. That competitor having the sports strap on must of course focus on defense while the opponent focuses on moves relating to offense.

In another variation one wrestler starts in forward head lock position, either on mat or on their feet. This variation can also focus on offense or defense by having only one wrestler wear the sports strap. The sports strap can be placed on the forward leg or the back leg. In a high crotch position the sports strap can be placed on either ankle to modify the training.

The sports strap of the present invention improves endurance, strength, speed, agility, flexibility and quickness of wrestlers. With regular wrestling the object is to pin one's opponent. Using the training device of the present invention, competitors are forced to practice many other moves such as, go behinds, take downs, roll outs from down positions, sit outs, front head lock, offense and defense, and the like in a short period of time while under the competitive pressure. While using the sports strap wrestlers will not only improve but learn the importance of head position, down blocking, low stance, creating angles for offense, continuous movement for defense motion, securing a leg, body awareness and the like.

There are also many wrestling competitions which can be played using the sports strap of the invention. Each of the variations discussed above under training can be put into a competitive wrestling game and competition between wrestlers is elevated to a sporting event.

For example in one embodiment the game comprises each wrestler wearing the sports strap around one ankle. First one to remove the other's wins. For more of a challenge the sports strap can be placed on lead leg. Rounds can be timed or first one to grab and take the other's competitors sport strap wins. In another variation the competitor attaches a sports strap to each of their ankles. The first wrestler to lose both straps loses.

In another variation the same rules apply as above except the wrestlers are not allowed to expose their back to the mat. If they do it counts as the same as the opponent grabbing and removing the sports strap. If two straps are being worn (one on each ankle) the one exposing his back must remove one of the straps.

Thus, the present invention provides an excellent training tool, games, and competitive venues. It is geared towards athletes from youth to elite level. While it comprises a wrestling type of competition or training tool, it can be used by athletes for any sport, since it increases muscle building, coordination and stamina. Of course it is understood that the forgoing are preferred embodiments, and that changes and variations can be made without departing from the spirit and essence of the invention.

What is claimed is:

1. A sports strap for use in athletic competition consisting essentially of:

an elongated ankle wrap portion of a soft, non-abrasive and flexible material of sufficient length to wrap around a competitor's ankle and overlap;

a releasable fastener for releasably securing the ankle wrap portion around the ankle of a competitor; and a pull strap extending from the exposed end of the ankle wrap portion when in a wrapped position, said pull strap being long enough and wide enough it can be grasped within a competitors closed hand and pulled by the hand of a competitor during the competition, without easily slipping through the competitor's grasp to release the fastener and sports strap from the ankle.

2. The sports strap of claim 1 wherein said fastener comprises a loop fastener pad secured to and extending from one side of said ankle wrap portion, on the side which will be the outside of said ankle wrap portion when used;

a hook fastener pad located adjacent the opposite end of said ankle wrap portion and extending therefrom on the opposite side from said loop pad, which will be the inner side of said ankle wrap portion when wrapped around an ankle.

3. The sports strap of claim 2 in which said loop fastener pad is about ¼ to ½ inch narrower than said ankle wrap, and from about ⅓ to ½ the length of said ankle wrap; and said hook pad is also about ¼ to ½ inch narrower than said ankle wrap, and has a length of from about 1 to 2 inches.

4. The sports wrap of claim 2 in which said ankle wrap has a length of about 15 inches, and a width is from about 1¾ inches; and said pull strap has a length of 6 inches, and a width is about 1 inch.

5. The sports strap of claim 4 in which said loop fastener pad is about ¼ to ½ inch narrower than said ankle wrap, and from about ⅓ to ½ the length of said ankle wrap; and said hook pad is also about ¼ to ½ inch narrower than said ankle wrap, and has a length of from about 1 to 2 inches.

6. The sports strap of claim 1 in which said ankle wrap has a length of 10 to 20 inches, and a width is from about 1¼ to about 2¼ inches; and said pull strap has a length of 6 to 10 inches, and a width is about ½ to about 1½ inches.

7. The sports strap of claim 1 in which said pull strap has a length of 6 to 10 inches.

8. A method of performing a wrestling type athletic competition comprising:

providing a sports strap to each of at least two competitors, said sports strap consisting essentially of:

an elongated ankle wrap portion of a soft, non-abrasive and flexible material of sufficient length to wrap around a competitor's ankle and overlap;

a releasable fastener for releasably securing the ankle wrap portion around the ankle of a competitor; and a pull strap extending from the exposed end of the ankle wrap portion when in a wrapped position, said pull strap being long enough and wide enough it can be grasped within a competitors closed hand and pulled by the hand of a competitor during the competition, without easily slipping through the competitor's grasp to release the fastener and sports strap from the ankle;

each said competitor wrapping and fastening one of said sports straps around at least one of his or her ankles;

assigning said competitors a starting position and having them assume said starting position; and starting said competition, each said competitor grappling with the other to grasp the pull strap of the sports strap wrapped around the other competitor's ankle, until one of said competitors grasps and pulls on the pull strap of the other competitor's sports strap, to unfasten the fastener, and thereby remove said sports strap from his or her competitor, thereby winning the competition.

9. The method of claim 8, in which said pull strap has a length of 6 to 10 inches.

10. The method of claim 8, wherein said fastener comprises a loop fastener pad secured to and extending from one side of said ankle wrap portion, on the side which will be the outside of said ankle wrap portion when used;

a hook fastener pad located adjacent the opposite end of said ankle wrap portion and extending therefrom on the opposite side from said loop pad, which will be the inner side of said ankle wrap portion when wrapped around an ankle.

11. The method of claim 10, in which said loop fastener pad is about ¼ to ½ inch narrower than said ankle wrap, and from about ⅓ to ½ the length of said ankle wrap; and said hook pad is also about ¼ to ½ inch narrower than said ankle wrap, and has a length of from about 1 to 2 inches.

12. The method of claim 10, in which said ankle wrap has a length of about 15 inches, and a width is from about 1¾ inches; and said pull strap has a length of 6 inches, and a width is about 1 inch.

13. The method of claim 8, in which said ankle wrap has a length of 10 to 20 inches, and a width is from about 1¼ to about 2¼ inches; and said pull strap has a length of 6 to 10 inches, and a width is about ½ to about 1½ inches.

14. The method of claim 8 in which said pull strap has a length of 6 to 10 inches.

15. A method of training a wrestler comprising:

providing a sports strap to at least one of at least two wrestlers, said sports strap consisting essentially of:

an elongated ankle wrap portion of a soft, non-abrasive and flexible material of sufficient length to wrap around a competitor's ankle and overlap;

a releasable fastener for releasably securing the ankle wrap portion around the ankle of a competitor; and a pull strap extending from the exposed end of the ankle wrap portion when in a wrapped position, said pull strap being long enough and wide enough it can be grasped within a competitors closed hand and pulled by the hand of a competitor during the competition, without easily slipping through the competitor's grasp to release the fastener and sports strap from the ankle;

each said wrestler wrapping and fastening one of said sports straps around at least one of his or her ankles;

assigning said competitors a starting position and having them assume said starting position; and starting said competition, each said competitor grappling with the other to grasp the pull strap of the sports strap wrapped around the other competitor's ankle, until one of said competitors grasps and pulls on the pull strap of the other competitor's sports strap, to unfasten the fastener, and thereby remove said sports strap from his or her competitor, thereby winning the competition;

starting said competition, said wrestlers grappling with each other, one to grasp the pull strap of the sports strap wrapped around the other wrestler's ankle, and the other to prevent the removal of the sports strap from his or her ankle, until said one of said wrestlers grasps and pulls on the pull strap to unfasten the fastener, and thereby remove said sports strap from the other wrestler thereby ending training period; timing said training period.

16. A method of training a wrestler of claim 15 in which said pull strap has a length of 6 to 10 inches.

17. A method of training a wrestler of claim 15 wherein said fastener comprises a loop fastener pad secured to and extending from one side of said ankle wrap portion, on the side which will be the outside of said ankle wrap portion when used;

a hook fastener pad located adjacent the opposite end of said ankle wrap portion and extending therefrom on the opposite side from said loop pad, which will be the inner side of said ankle wrap portion when wrapped around an ankle.

18. A method of training a wrestler of claim 17 in which said loop fastener pad is about ¼ to ½ inch narrower than said ankle wrap, and from about ⅓ to ½ the length of said ankle wrap; and said hook pad is also about ¼ to ½ inch narrower than said ankle wrap, and has a length of from about 1 to 2 inches.

19. The method of claim 17 in which said ankle wrap has a length of about 15 inches, and a width is from about 1¾ inches; and said pull strap has a length of 6 inches, and a width is about 1 inch.

20. The method of claim 15 in which said ankle wrap has a length of 10 to 20 inches, and a width is from about 1¼ to about 2¼ inches; and said pull strap has a length of 6 to 10 inches, and a width is about ½ to about 1½ inches.

21. The method of claim 15 in which said pull strap has a length of 6 to 10 inches.

* * * * *